US007022096B1

(12) United States Patent
Alfieri

(10) Patent No.: US 7,022,096 B1
(45) Date of Patent: Apr. 4, 2006

(54) ANKLE PAD

(76) Inventor: Antonino Alfieri, Stefan-George-Ring 5, Munich (DE) 81929

( * ) Notice: Subject to any disclaimer, the term of this patent is extended or adjusted under 35 U.S.C. 154(b) by 169 days.

(21) Appl. No.: 10/111,617

(22) PCT Filed: Oct. 23, 2000

(86) PCT No.: PCT/EP00/10403

§ 371 (c)(1),
(2), (4) Date: Jul. 29, 2002

(87) PCT Pub. No.: WO01/32273

PCT Pub. Date: May 10, 2001

(30) Foreign Application Priority Data

Oct. 28, 1999 (DE) ..... 199 51 990

(51) Int. Cl.
*A61F 5/00* (2006.01)

(52) U.S. Cl. ..... 602/65; 602/23; 602/27; 602/60

(58) Field of Classification Search ..... 602/5, 602/23, 27, 28, 29, 60, 65; 128/869, 882; 2/22, 911; D24/192
See application file for complete search history.

(56) References Cited

U.S. PATENT DOCUMENTS

| | | | | |
|---|---|---|---|---|
| 3,383,708 | A | 5/1968 | Pappas | |
| 3,674,023 | A * | 7/1972 | Mann | 602/65 |
| 4,409,976 | A * | 10/1983 | Pence | 602/65 |
| 4,495,942 | A * | 1/1985 | Palumbo | 602/27 |
| 4,527,556 | A * | 7/1985 | Nelson | 602/27 |
| 4,630,600 | A | 12/1986 | Spencer et al. | |
| 4,865,023 | A | 9/1989 | Craythorne et al. | |
| 5,090,404 | A * | 2/1992 | Kallassy | 602/65 |
| 5,135,473 | A * | 8/1992 | Epler et al. | 602/62 |
| 5,271,418 | A * | 12/1993 | Ohnuma et al. | 128/882 |
| 5,301,370 | A * | 4/1994 | Henson | 2/22 |

(Continued)

FOREIGN PATENT DOCUMENTS

DE 6802095 10/1968

(Continued)

OTHER PUBLICATIONS

Office Action from German Patent Office.

*Primary Examiner*—Henry Bennett
*Assistant Examiner*—Amanda Wieker
(74) *Attorney, Agent, or Firm*—Marshall, Gerstein & Borun LLP

(57) ABSTRACT

An ankle guard consisting of a band-shaped padding (14), with a substantially U-shaped longitudinal cross-section, which is configured to essentially cover the circumference of the foot in the vicinity of the ankle. A closure device (18) is provided to close the open section of the U-shaped padding, allowing the ankle guard to be put on in a particularly simple manner. The padding (14) comprises an internal section (20), facing towards the foot (12) and an external section (22), facing away from the foot (12) which consist of a durable material and are connected in a fixed manner at the edges of their outer peripheries. A foam cushion (24) is positioned between the internal section (20) and the external section (22). In the lateral region of the foot (26), in the vicinity of the outward-facing ankle-bone, a protective element (30), consisting of a semi-rigid material with elastic properties is located between the external section (22) and the foam cushion (24), the protective element (30) being smaller than the foam cushion (24). This configuration ensures that the entire lateral foot region at the ankle level, including the ligaments and ankle-joint, are effectively protected against injury.

37 Claims, 10 Drawing Sheets

U.S. PATENT DOCUMENTS

| | | | | | |
|---|---|---|---|---|---|
| 5,507,720 | A | * | 4/1996 | Lampropoulos | 602/27 |
| 5,520,628 | A | * | 5/1996 | Wehr | 602/27 |
| 5,637,077 | A | | 6/1997 | Parker | |
| 5,865,778 | A | * | 2/1999 | Johnson | 602/27 |
| 5,868,693 | A | * | 2/1999 | Duback et al. | 602/27 |
| 6,155,997 | A | * | 12/2000 | Castro | 602/27 |
| 6,245,035 | B1 | * | 6/2001 | Schrijver | 602/27 |

FOREIGN PATENT DOCUMENTS

| | | | |
|---|---|---|---|
| DE | 7334227 | | 12/1973 |
| EP | 0 682 960 | A1 | 11/1995 |
| GB | 2016905 | * | 10/1979 |
| GB | 2068710 | * | 8/1981 |
| WO | WO 9423672 | * | 10/1994 |

* cited by examiner

ANKLE PAD

This application is the United States national stage, under 35 U.S.C. §371, of International Patent Application PCT/EP00/10403, filed Oct. 23, 2000. This application further claims priority to Germany patent application serial number 199 51 990.0, filed Oct. 28, 1999.

FIELD OF THE INVENTION

The present invention relates to an ankle pad, and more particularly to an ankle pad providing protection against blows in the ankle area.

EP 0 682 960 A1 discloses an ankle pad comprising an elastic sock made of a textile material and provided with three openings, a first opening being provided for the leg area of the foot, a second opening for the toe area of the foot and a third opening for the heel area of the foot. On the ankle a nutshell-shaped protection element is secured in position on the inner side of the elastic sock, the cavity of said protection element being padded with pellets of foamed plastic. For retaining the pellets of foamed plastic in the cavity of the protection element, a lattice of textile material is provided between the foot and the protection element. This embodiment is disadvantageous insofar as it only protects the ankle as such, but not the surroundings thereof, e.g. the ligaments and the ankle joint. In addition, blows which act on the foot at an oblique angle may cause injuries when the boundary areas of the protection element consisting of a rigid material act directly onto the foot.

BACKGROUND OF THE INVENTION

It is the object of the present invention to provide an ankle pad which is simple to handle and which offers a high degree of protection against blows and kicks in the area of the ankle.

SUMMARY OF THE INVENTION

This object is achieved by the features disclosed in the main claim.

The ankle pad according to the present invention comprises a strip-shaped pack which has a substantially U-shaped longitudinal cross-section and which is implemented such that it substantially covers the circumference of the foot in the ankle area. For closing the open section of the U-shaped pack, a closure is provided. This structural design guarantees that the ankle pad can be put on in a particularly simple manner. The pack is composed of an inner component facing the foot and an outer component facing away from the foot, such inner and outer components consisting of a durable clothing material and being fixedly interconnected along the outer circumferential edges thereof. A foam pad is arranged between the inner and outer components. In the lateral foot area of the ankle facing outwards a protection element is formed between the outer component and the foam pad, the protection element consisting of a semirigid material with elastic properties and being smaller than the foam pad. This arrangement guarantees that part of the kinetic energy of blows and kicks will be absorbed by the protection element. The impact load applied through a small area is therefore transferred to a comparatively large area and cushioned still further by the foam pad. It follows that the whole lateral foot area, including the ligaments and the ankle joint, is effectively protected on the level of the ankle.

Advantageous further developments of the present invention are disclosed in the subclaims.

BRIEF DESCRIPTION OF THE DRAWINGS

The present invention is explained in detail making reference to the drawings, in which.

DETAILED DESCRIPTION OF THE INVENTION

Figure 1:
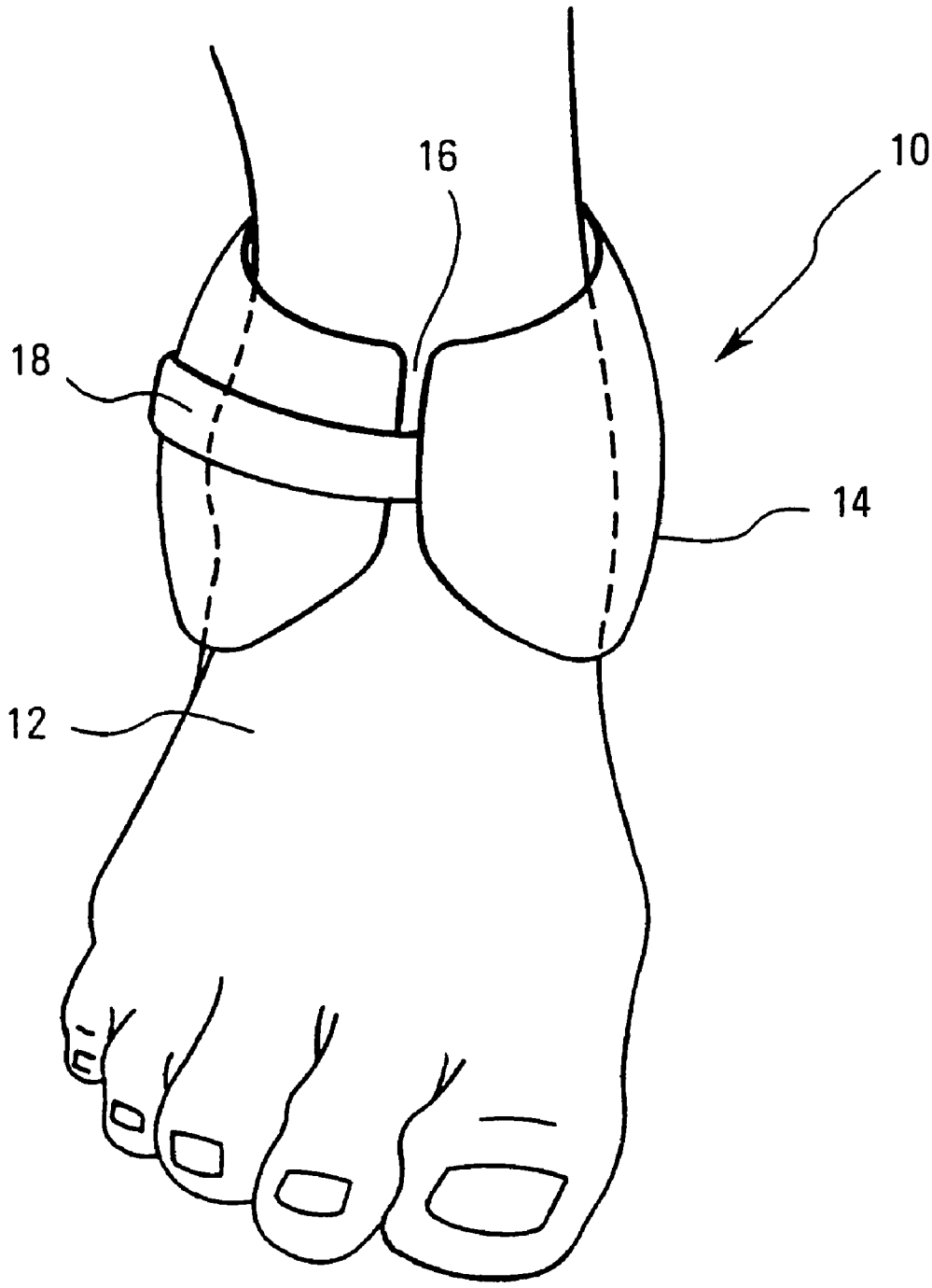
FIG. 1 shows a front view of an ankle pad according to the present invention, the ankle pad being applied to the foot of a user, e.g. a football player.
Figure 9:
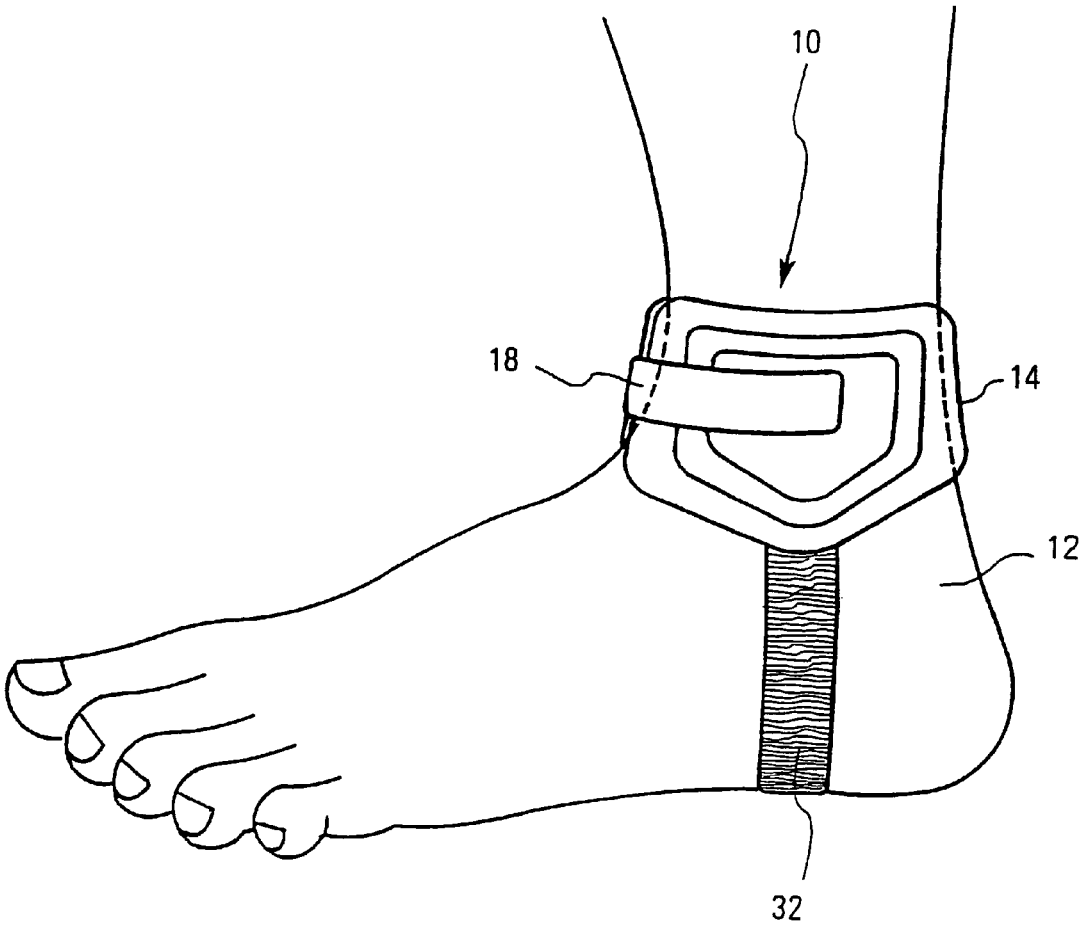
FIG. 9 shows a side view of the ankle pad according to FIG. 1, the ankle pad being applied to a foot.

FIGS. 1 and 9 show a front view and a side view of an ankle pad 10 applied to a foot 12. The ankle pad 10 comprises a strip-shaped pack 14 having a substantially U-shaped longitudinal cross-section (cf. especially FIG. 5).

Figure 5:
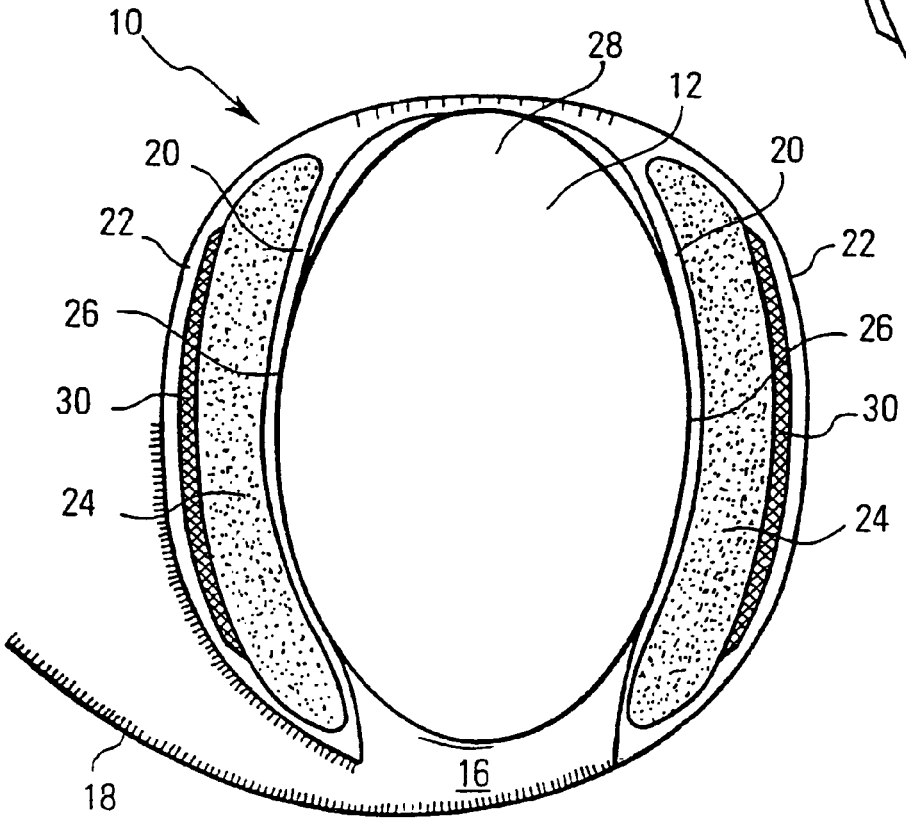
FIG. 5 shows a cross-sectional view of the ankle pad of FIG. 1.

The pack 14 covers the circumference of the foot almost completely in the ankle area (FIGS. 1 and 5). An open section 16 of the pack 14 can be closed on the foot 12 by means of a closure 18. In the case of the present embodiment the closure 18 is a Velcro (Trademark) material. In a modified embodiment, the closure 18 is implemented as a belt closure means.

As can be seen from FIG. 5, the pack 14 is composed of an inner component 20 facing the foot 12 and of an outer component 22 facing away from the foot 12. The materials for the inner component 20 and the outer component 22 are preferably durable and weatherproof. The material for the inner component 20 is preferably kind to the skin so as to provide conditions under which the ankle pad 10 can be applied directly to the foot 12. Materials which are suitable to be used for the inner component 20 and the outer component 22 are e.g. leather, artificial leather, a nylon fabric of the type used e.g. for travelling bags, or PTFE.

The inner component 20 and the outer component 22 are fixedly interconnected along the outer circumferential edges thereof. In the present embodiment, the outer circumferential edges of the inner component 20 and of the outer component 22 are sewn together. In a modified embodiment, the outer circumferential edges of the inner component 20 and of the outer component 22 are joined by an adhesive.

A pad of foamed plastic 24 is arranged between the inner component 20 and the outer component 22, said foam pad 24 being dimensioned such that it covers the whole lateral area 26 of the foot 12 on the level of the ankle. The foam pad 24 consists of an elastic, spongelike material, such as foamed polyvinyl chloride, polystyrene, polyethylene or polyurethane.

In the embodiment shown in FIG. 5, the inner component 20 and the outer component 22 are directly and fixedly interconnected in the heel area 28, e.g. by sewing or by means of an adhesive, so that a foam pad 24 for the inner ankle and a foam pad 24 for the outer ankle are provided. In a modified embodiment, the foam pad 24 can also be provided in the form of a continuous pad which encompasses the heel area 28. In order to increase the ease of wearing of the ankle pad 10, the modified embodiment is so conceived that the foam pad 24 in the heel area 28 is thinner than the foam pad 24 in the lateral areas 26 of the foot.

In the lateral areas 26 of the foot respective protection elements 30 are provided between the outer component 22 and the foam pad 24. The longitudinal and lateral dimensions of these protection elements 30 are smaller than those of the foam pads 24 (cf. FIG. 3). The protection element 30 is produced from a semirigid material having elastic properties, such as e.g. polypropylene, polyvinyl chloride, polystyrene, polyethene, polypropene, polybutene, polymethylpentene, carbon fiber materials or combinations of these materials.

In a modification of the embodiment described, a protection element 30 is only provided in the area of the ankle facing outwards.

Figure 3:
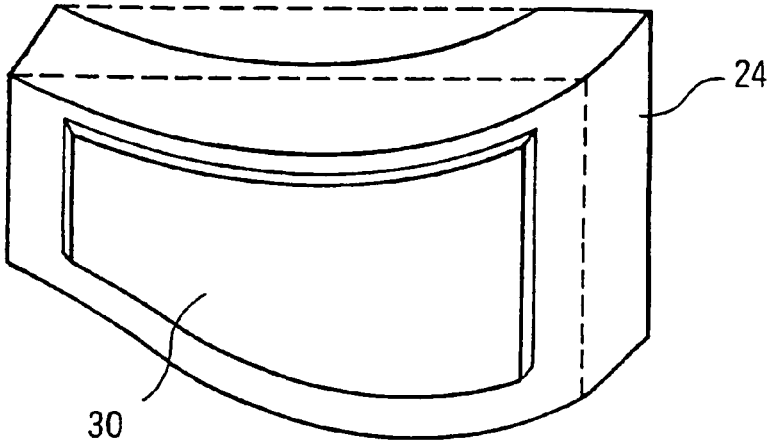
FIG. 3 shows a perspective front view of a combination of the foam pad and of the protection element for the ankle pad.
Figure 4:
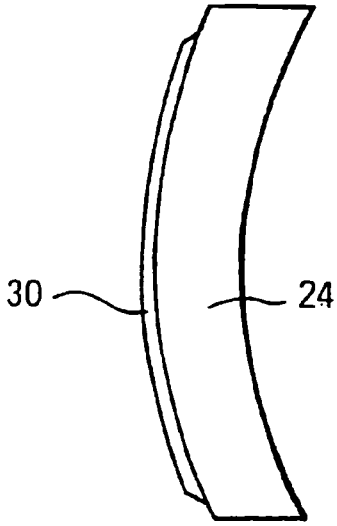
FIG. 4 shows a top view of the combination according to FIG. 3.

As can be seen in FIGS. 3 and 4, the combination of the foam pad 24 and of the protection element 30 is implemented such that it has a curved shape. This curvature is either created such that the foam pad 24 and the protection element 30 are joined by means of an adhesive and maintained in a curved shape until the adhesive has hardened. Another possibility of creating the curvature is that the protection element 30 is caused to assume the desired shape under thermal influence and the foam pad 24 is then glued onto the curved protection element 30.

Figure 8:
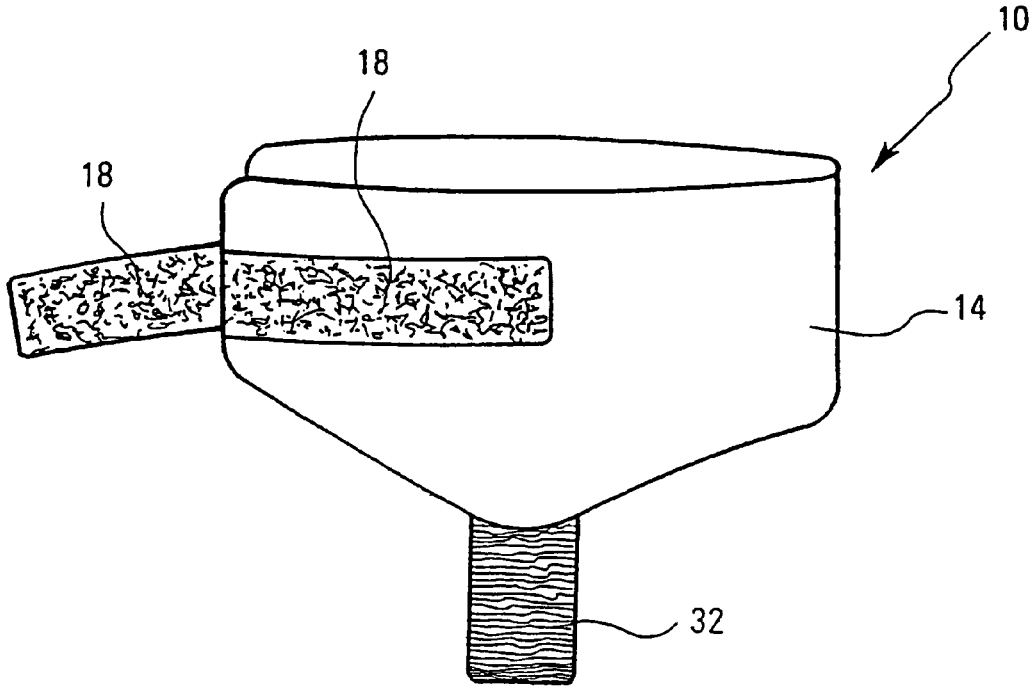
FIG. 8 shows a perspective side view of the ankle pad in the open condition.

As can be seen in FIGS. 8 and 9, a retaining strip 32 extends substantially at right angles to the longitudinal direction of the pack 14, said retaining strip 32 extending from the outer ankle area of the pack 14 to the inner ankle area of the pack 14. The retaining strip 32 is preferably produced from an elastic material, e.g. a rubber band.

Figure 6:
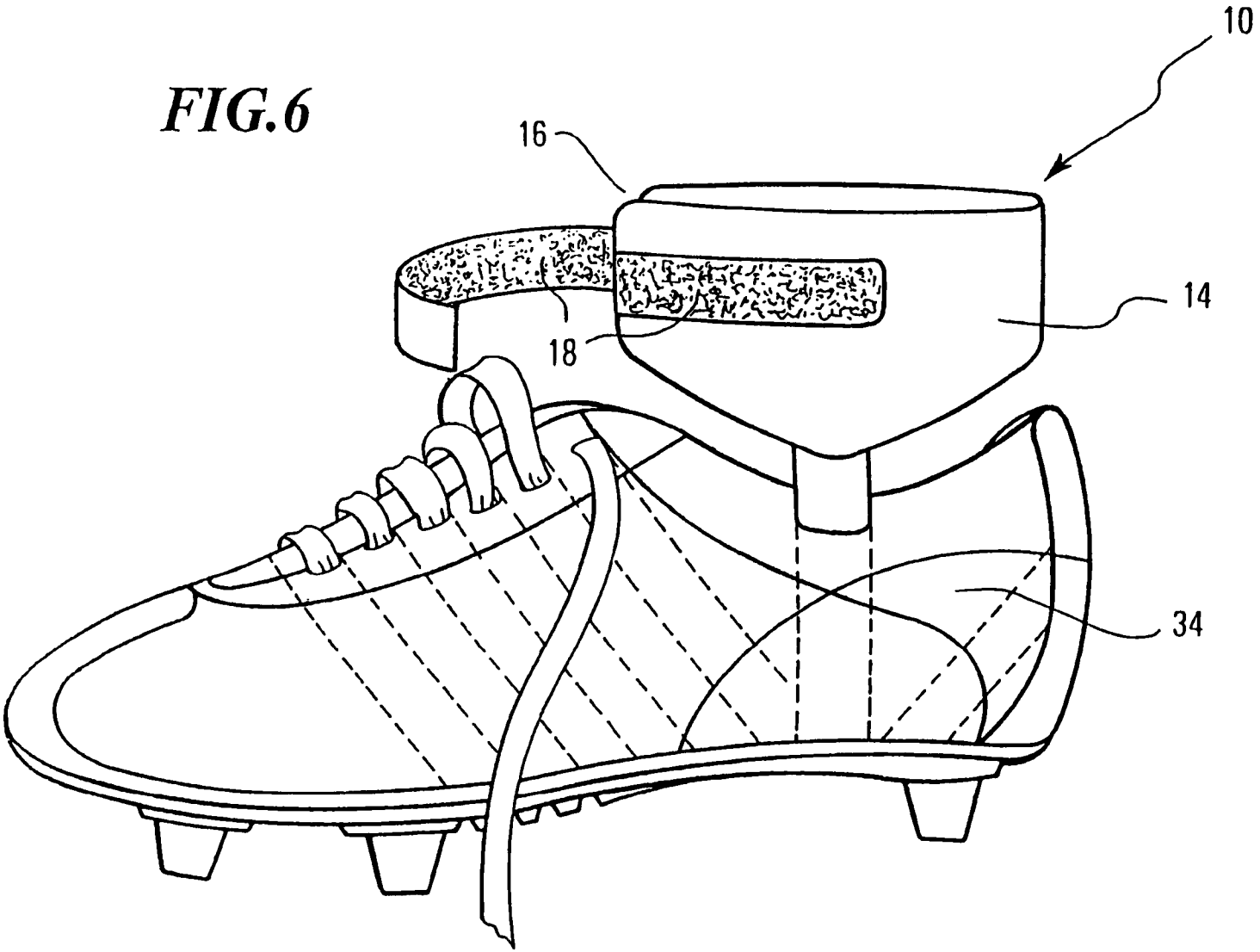
FIG. 6 shows a side view of a shoe equipped with the ankle pad according to FIG. 1, the closure being open.

As can be seen in FIG. 6, the ankle pad 10 is connected to a shoe 34 in accordance with a modified embodiment.

Figure 2A:
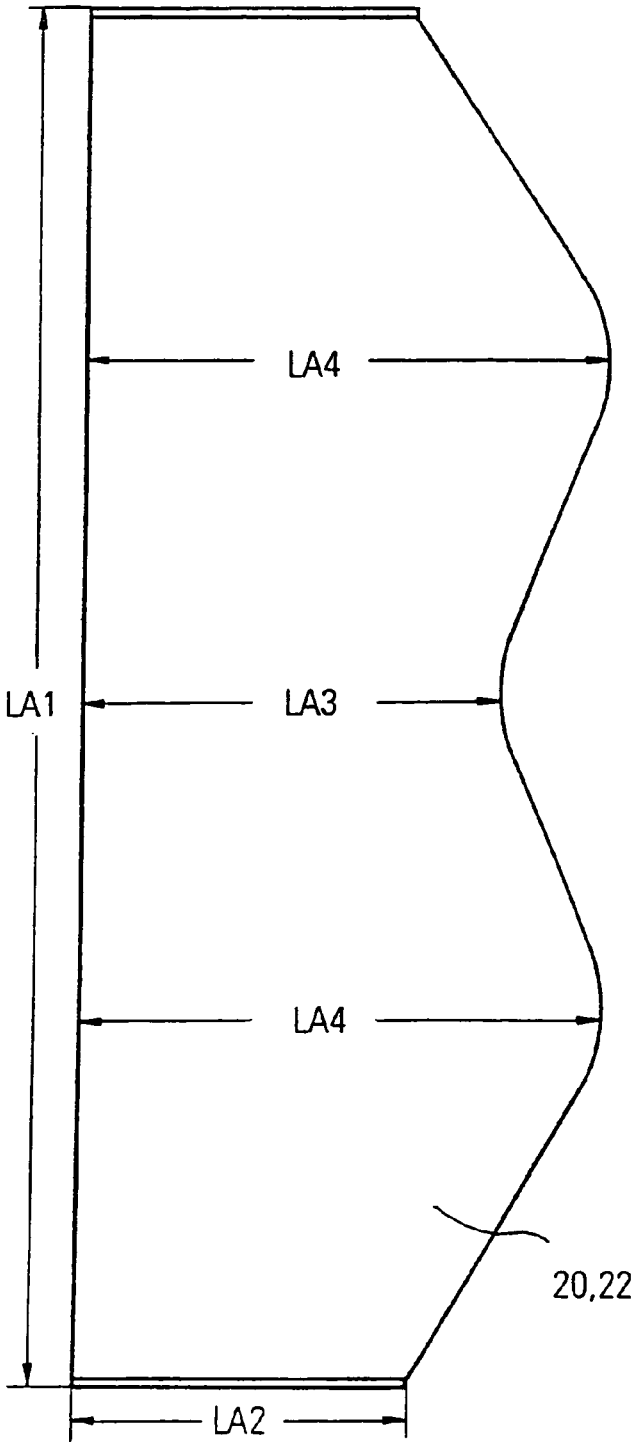
FIG. 2A shows a cut of an inner component or of an outer component of the ankle pad.

FIG. 2A shows the cut of the inner component 20 and of the outer component 22 for the pack 14. The inner component 20 and the outer component 22 have preferably the following dimensions: LA1: 270 mm, LA2: 60 mm, LA3: 80 mm and LA4: 90.5 mm. As can be seen from FIG. 2A, the width gradually increases from LA2 to a summit LA4, and from that summit it gradually decreases down to the width LA3.

These dimensions correspond to the normal size of a foot and, depending on the actual circumstances, they may smaller as well as larger.

Figure 2B:
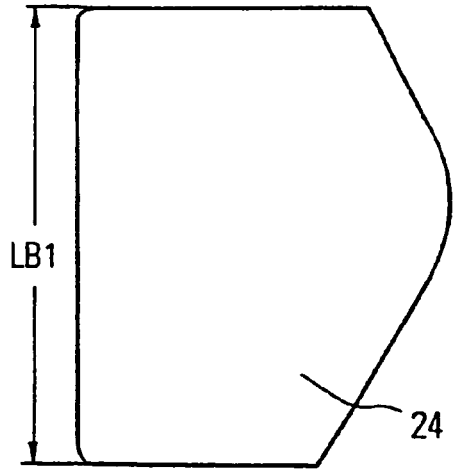
FIG. 2B shows cut of a foam pad of the ankle pad.

The length LB1 of the foam pad 24 shown in FIG. 2B is preferably 90 mm. The width is adapted to the dimensions of the inner component 20 and of the outer component 22. The thickness is approx. 10 mm.

Figure 2C:
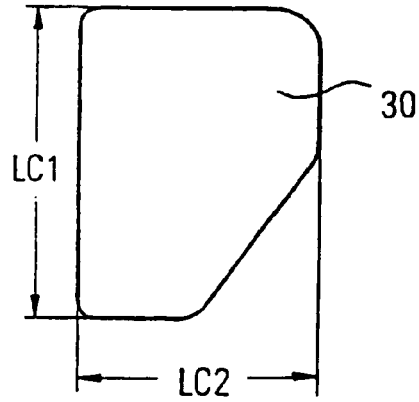
FIG. 2C shows a cut of a protection element of the ankle pad.

In FIG. 2C the length LC1 of the protection element 30 is 60 mm and the width LC2 is 40 mm. The thickness of the protection element 30 is preferably between 1 mm and 2 mm.

In the case of another embodiment, which is not shown, the inner component 20 and the outer component 22 for the left lateral area 26 of the foot and for the right lateral area 26 of the foot are implemented separately and connected by a connection element in the heel area 28. The connection element preferably consists of an elastic material, e.g. a rubber band. The connection element may also be lined with a foam pad element, analogously to the foam pad 24.

In the following, it will be explained how the ankle pad 10 is put on.

In accordance with a first variant, the football player first puts on his shin guards. Subsequently, the player puts on the ankle pad 10 by applying the retaining strip 32 to the sole of the foot in the open condition of the ankle pad 10, and by enclosing the circumference of the foot with the U-shaped pack 14. Following this, the closure 18 is closed so that the ankle pad 10 will substantially encompass the circumference of the foot in the ankle area. Subsequently, the football player puts on his stockings and then his shoes 34.

Figure 7:
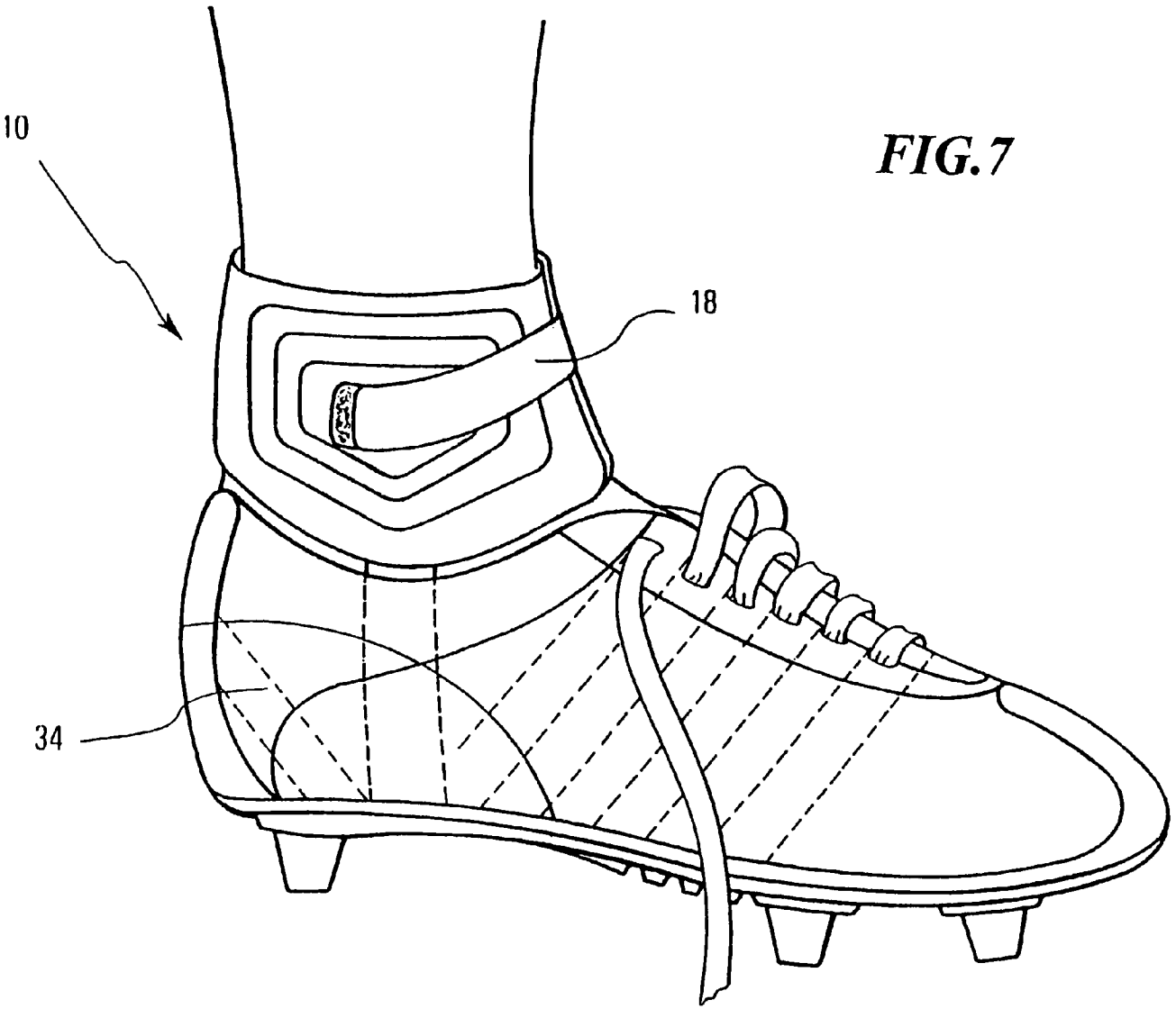
FIG. 7 shows a side view of a foot dressed in a shoe and having the ankle pad according to FIG. 1 applied thereto, the closure of the ankle pad being closed.

In accordance with a second variant, the football player first puts on his shin guards. Subsequently, the football player puts on his stockings. The ankle pad 10 is then put on in a manner corresponding to that described in connection with the first variant. Following this, the football player puts on his shoes 34 (FIG. 7).

In addition to the advantages mentioned in the introduction to the specification, the following advantages are obtained. On the basis of the structural design according to the present embodiment, the ankle pad 10 has little weight. In view of the fact that the ankle pad 10 can be put on easily and without any difficulties, it can also be used by children, young persons and adolescents. The football player using the ankle pad 10 will feel safer and this will improve his performance on the football field. The ankle pad 10 has little weight and can be produced at a reasonable price. Furthermore, the ankle pad 10 will not have any negative effects on the football player during the game.

Figure 10:
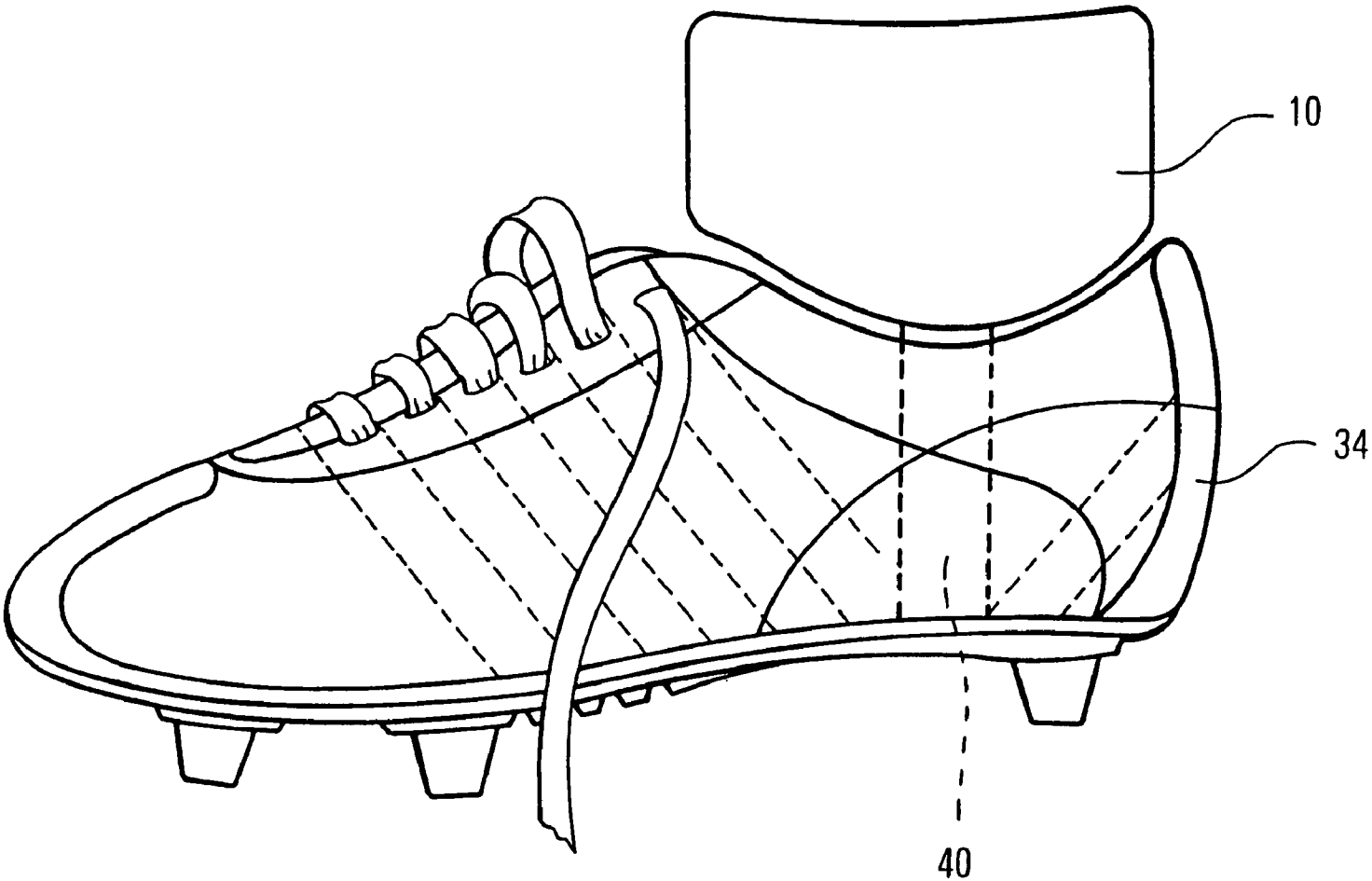
FIG. 10 shows a side view of the ankle pad according to FIG. 1, the ankle pad being secured to a shoe.

FIG. 10 shows the shoe 34 having the ankle pad 10 connected thereto via a fastening means 40. The fastening means 40 can be implemented as a releasable means, e.g. in the form of a press fastener, or as a fixed means, e.g. in the form of a rivet connecting the ankle pad 10 inseparably to the shoe 34.

Figure 11:
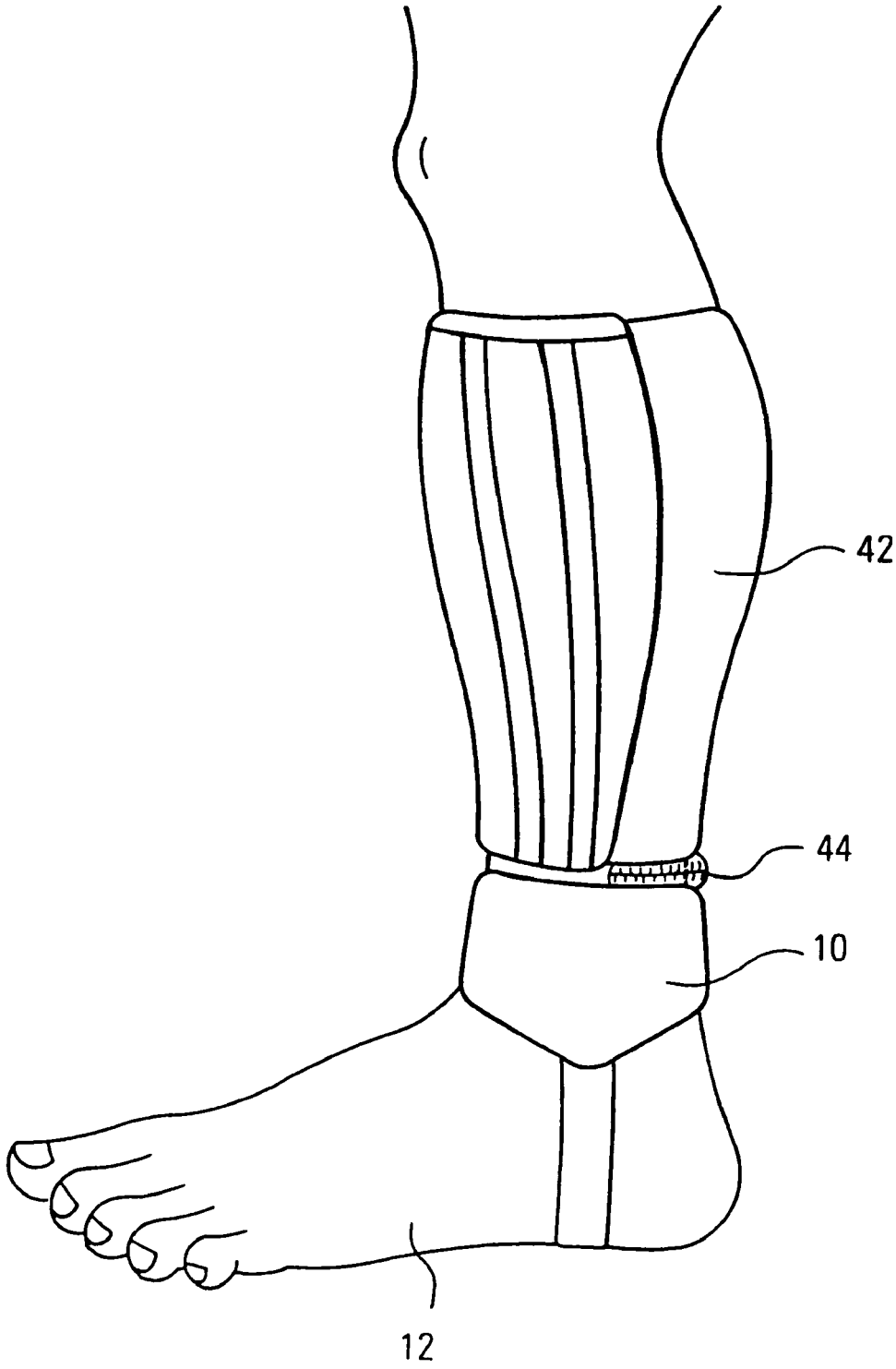
FIG. 11 shows a side view of the ankle pad according to FIG. 1, the ankle pad being connected to a shin guard in accordance with a first embodiment.
Figure 12:
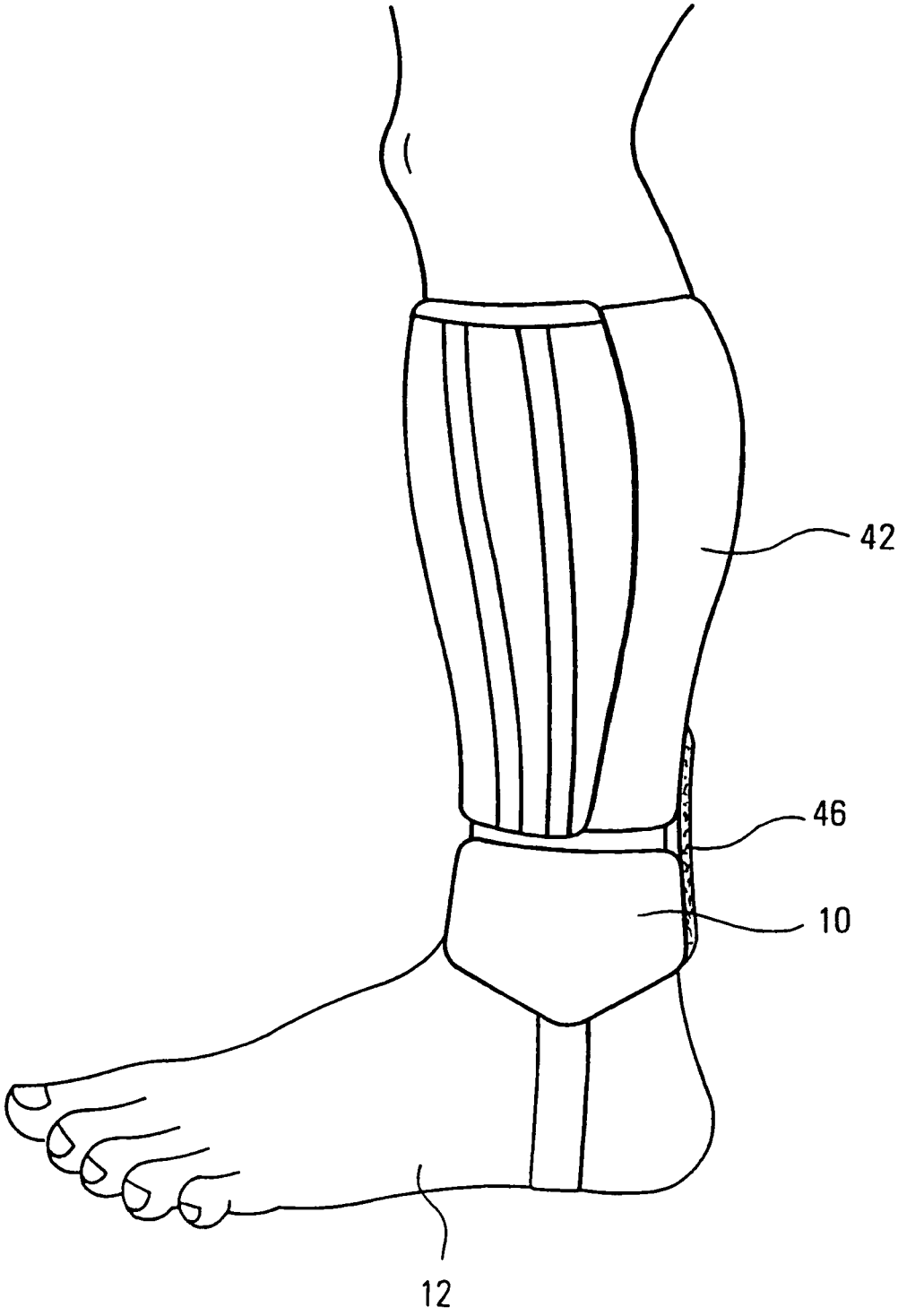
FIG. 12 shows a side view of the ankle pad according to FIG. 1, the ankle pad being connected to a shin guard in accordance with a second embodiment.

FIGS. 11 and 12 show a combination of the ankle pad 10 and of a shin guard 42.

FIG. 11 shows the shin guard 42, the shin guard area facing the foot 12 being releasably connected to the ankle pad 10 via a zip-fastener 44.

FIG. 12 shows the shin guard 42, the shin guard area facing the foot 12 being releasably connected to the ankle pad 10 via a shin-guard Velcro (Trademark) member.

The ankle pad 10 according to the embodiments shown in FIGS. 11 and 12 is put on in the manner described hereinbefore, the only difference being that the connection between the shin guard 42 and the ankle pad 10 has to be additionally established.

In the case of an embodiment which is not shown, the ankle pad is formed integrally with the shin guard 42.

Variants consisting of mixtures of the above embodiments and their modifications are possible.

What is claimed is:

1. An ankle pad, comprising in combination a strip-shaped pack which has a substantially U-shaped longitudinal cross-section and which is implemented such that it covers the circumference of the foot substantially completely in the ankle area, and a closure for closing an open section of the U-shaped pack, said pack being defined by an inner component facing the foot and an outer component facing away from the foot, said inner and outer components comprising a durable clothing material and being fixedly interconnected along the outer circumferential edges thereof, a foam pad being arranged between said inner component and said outer component, and a protection element being directly arranged in the lateral foot area of the ankle facing outwards between said outer component and said foam pad, said protection element comprising a semirigid material with elastic properties without curing or hardening before use and being smaller than said foam pad, wherein at the heel area of the foot said inner component and said outer component are directly interconnected without any intermediate foam pad.

2. An ankle pad according to claim 1 wherein said inner component and said outer component each gradually increase in width from the end edge to the ankle area and gradually decrease in width from the ankle area to the heel area.

3. An ankle pad according to claim 1, wherein a retaining strip extends from the ankle area of said pack facing outwards to the ankle area of said pack facing inwards and essentially at right angles to the longitudinal direction of said U-shaped pack.

4. An ankle pad according to claim 3, wherein said retaining strip is made of an elastic material.

5. An ankle pad according to claim 1, wherein said closure is a hook and loop fastener.

6. An ankle pad according to claim 1, wherein said closure is a belt closure.

7. An ankle pad according to claim 1 wherein the ankle pad is connected to a shoe.

8. An ankle pad according to claim 7, wherein the ankle pad is connected to the shoe by means of one or a plurality of rivets.

9. An ankle pad according to claim 7, wherein the ankle pad is connected to the shoe by means of one or a plurality of press fasteners.

10. An ankle pad according to claim 1, wherein said inner component and said outer component of said pack are comprised of leather, artificial leather, nylon fabric, or PTFE.

11. An ankle pad according to claim 1, wherein said foam pad comprises a foamed polyvinyl chloride, polystyrene, polyethylene or polyurethane.

12. An ankle pad according to claim 1, wherein said protection element is implemented as a curved element.

13. An ankle pad according to claim 1, wherein said protection element comprises polypropylene, polyvinyl chloride, polystyrene, polyethene, polypropene, polybutene, polymethylpentene, or carbon fiber materials or of combinations of these materials.

14. An ankle pad according to claim 1, wherein the ankle pad is connected to a shin guard.

15. An ankle pad according to claim 14, wherein the ankle pad is connected to the shin guard by means of a zip-fastener.

16. An ankle pad according to claim 14, wherein the ankle pad is connected to the shin guard by means of a shin-guard hook and loop fastener.

17. An ankle pad, comprising a strip-shaped pack which has a substantially U-shaped longitudinal cross-section and which is implemented such that it covers the circumference of the foot substantially completely in the ankle area, and a closure for closing an open section of the U-shaped pack, said pack being defined by an inner component facing the foot and an outer component facing away from the foot, said inner and outer components comprising a durable clothing material and being fixedly interconnected along the outer circumferential edges thereof, a foam pad being directly arranged between said inner component and said outer component, and a protection element being arranged in the lateral foot area of the ankle facing outwards between said outer component and said foam pad, said protection element comprising a semirigid material with elastic properties without curing or hardening before use and being smaller than said foam pad, wherein said inner component and said outer component each gradually increase in width from the end edge to the ankle area and gradually decrease in width from the ankle area to the heel area.

18. An ankle pad according to claim 17, wherein at the heel area of the foot said inner component and said outer component are directly interconnected without any intermediate foam pad.

19. An ankle pad according to claim 17, wherein a retaining strip extends from the ankle area of said pack facing outwards to the ankle area of said pack facing inwards and essentially at right angles to the longitudinal direction of said U-shaped pack.

20. An ankle pad according to claim 19, wherein said retaining strip is made of an elastic material.

21. An ankle pad according to claim 17, wherein said closure is a hook and loop fastener.

22. An ankle pad according to claim 17, wherein said closure is a belt closure.

23. An ankle pad according to claim 17, wherein the ankle pad is connected to a shoe.

24. An ankle pad according to claim 17, wherein said inner component and said outer component of said pack are comprised of leather, artificial leather, nylon fabric, or PTFE.

25. An ankle pad, comprising in combination a strip-shaped pack which has a substantially U-shaped longitudinal cross-section and which is implemented such that it covers the circumference of the foot substantially completely in the ankle area, and a closure for closing an open section of the U-shaped pack, said pack being defined by an inner component facing the foot and an outer component facing away from the foot, said inner and outer components comprising a durable clothing material and being fixedly interconnected along the outer circumferential edges thereof, a foam pad being directly arranged between said inner component and said outer component, and a protection element being arranged in the lateral foot area of the ankle facing outwards between said outer component and said foam pad, said protection element comprising a semirigid material with elastic properties without curing or hardening before use and being smaller than said foam pad, wherein the ankle pad is connected to a shin guard.

26. An ankle pad according to claim 25, wherein at the heel area of the foot said inner component and said outer component are directly interconnected without any intermediate foam pad.

27. An ankle pad according to claim 25 or 26, wherein said inner component and said outer component each gradually increase in width from the end edge to the ankle area and gradually decrease in width from the ankle area to the heel area.

28. An ankle pad according to claim 25, wherein a retaining strip extends from the ankle area of said pack facing outwards to the ankle area of said pack facing inwards and essentially at right angles to the longitudinal direction of said U-shaped pack.

29. An ankle pad according to claim 28, wherein said retaining strip is made of an elastic material.

30. An ankle pad according to claim 25, wherein said closure is a hook and loop fastener.

31. An ankle pad according to claim 25, wherein said closure is a belt closure.

32. An ankle pad according to claim 25, wherein said inner component and said outer component of said pack are comprised of leather, artificial leather, nylon fabric, or PTFE.

33. An ankle pad according to claim 25, wherein said foam pad comprises a foamed polyvinyl chloride, polystyrene, polyethylene or polyurethane.

34. An ankle pad according to claim 25, wherein said protection element is implemented as a curved element.

35. An ankle pad according to claim 25, wherein said protection element comprises polypropylene, polyvinyl, polystyrene, polyethene, polypropene, polybutene, polymethylpentene, or carbon fiber materials or of combinations of these materials.

36. An ankle pad according to claim 25, wherein the ankle pad is connected to the shin guard by means of a zip fastener.

37. An ankle pad according to claim 25, wherein the ankle pad is connected to the shin guard by means of a shin-guard hook and loop fastener.

* * * * *